United States Patent [19]

Leone

[11] 3,953,954

[45] May 4, 1976

[54] METAL U-CHANNEL SHAPED ELEMENT FOR REINFORCING FLOORS OF CONCRETE AND LIGHTENING FILLING BLOCKS

[76] Inventor: Salvatore Leone, Residenza al Parco 11.3.301, Milan 2, 20090 Segrate, Italy

[22] Filed: Nov. 19, 1974

[21] Appl. No.: 525,071

[30] Foreign Application Priority Data

Nov. 21, 1973 Italy ..... 31505/73

[52] U.S. Cl. ..... 52/720; 52/414

[51] Int. Cl.[2] ..... E04B 1/14; E04C 5/00

[58] Field of Search ..... 52/319–341, 52/720, 724, 434, 723, 730–732, 334, 414, 733

[56] References Cited

UNITED STATES PATENTS

| | | | |
|---|---|---|---|
| 947,514 | 1/1910 | Stevens | 52/724 |
| 1,064,163 | 6/1913 | Pement et al. | 52/724 |
| 2,194,536 | 3/1940 | White | 52/724 |
| 2,233,291 | 2/1941 | Leebov | 52/724 |
| 2,775,019 | 12/1956 | Bemis | 52/327 |
| 3,828,505 | 8/1974 | Leone | 52/654 |

FOREIGN PATENTS OR APPLICATIONS

| | | | |
|---|---|---|---|
| 69,458 | 7/1915 | Austria | 52/720 |
| 165,191 | 6/1949 | Austria | 52/720 |
| 902,956 | 9/1945 | France | 52/723 |
| 180,383 | 4/1953 | Austria | 52/434 |
| 560,977 | 10/1957 | Belgium | 52/368 |
| 582,409 | 9/1958 | Italy | 52/327 |
| 1,162,233 | 4/1958 | France | 52/690 |
| 275,109 | 7/1951 | Switzerland | 52/329 |

OTHER PUBLICATIONS

French Addition 73,318, 6–1960, 6 pp. of Dwg., 7 pp. of spec., 2nd Add. to Fr. 1,162,523.

*Primary Examiner*—Ernest R. Purser
*Assistant Examiner*—James L. Ridgill, Jr.
*Attorney, Agent, or Firm*—Phillips, Moore, Weissenberger Lempio & Strabala

[57] ABSTRACT

A metal U-channel shaped element for reinforcing floor joists in building floors made of concrete and light material filling blocks, such as tiles, is made of a continuous metal section with a substantially U-shaped cross-section. The legs of the channel are symmetrically bent inwards so that the cross-section has rather the sahpe of an isosceles trapezoid and their free ends are also bent on itself in an overlapping relationship thus forming two upper stringers having a resisting moment not less than that of the channel bottom. Rigid U-shaped stiffening members are also provided in a spaced apart relationship, being fixed to the upper stringers and channel bottom.

8 Claims, 3 Drawing Figures

METAL U-CHANNEL SHAPED ELEMENT FOR REINFORCING FLOORS OF CONCRETE AND LIGHTENING FILLING BLOCKS

BACKGROUND OF THE INVENTION

The present invention relates to a metal U-channel shaped element for reinforcing concrete floors, and in particular a self-supporting element suitable for being embedded in a concrete casting so as to form the reinforcement of the floor joists on which light material filling blocks, such as tiles, are made to rest in the technique of building floors made of concrete and blocks.

It is known that at present in the building technique trestleworks of floors, vaults and the like are made by using prefabricated reinforced concrete joists or by building such joists where required by embedding a suitable metal reinforcing structure in a concrete casting.

The utilization of prefabricated joists shows the drawback that certain given standard sizes are needed with the consequence that the possible degrees of freedom are reduced both in planning and in building. Furthermore, in this case, the user cannot reliably check the pattern, the steadiness and in general all the features of the reinforcement.

On the other hand, the joists formed in an erecting yard from time to time, show well known inconveniences, such as of requiring time consuming handmade iron or wood structural works for arranging reinforcing rods and installing the necessary boxings. Such works involve costly labor, in addition to obvious environmental difficulties.

It is true that the same Applicant has designed and produced a pre-formed self-supporting metal trestle, adapted to be manufactured in a factory by means of industrial methods and apparatuses and hence to be supplied into the building yards at the desired lengths in order to be embedded in a concrete casting with no need of boxing or molds. Such metal trestle, being the object of the U.S. Pat. No. 3,828,505, requires however for its manufacturing plants and machines of high cost and complexity, having a trestle production per hour which does not fulfill the building demand and what would be desirable in order to conveniently utilize the production plants from the economical point of view.

SUMMARY OF THE INVENTION

It is an object of the present invention to provide a U-channel shaped metal element having, with respect to the prior art, the same advantages as the pre-formed trestle above discussed, but being adapted to be manufactured by means of simple, low-cost known machines, with a high production per hour.

The U-channel shaped element according to the invention is characterized in that it comprises, a continuous metal section having substantially a U-shaped cross-section with its legs symmetrically bent inwards at their free outer end, thereby forming two upper stringers, the resisting moment of which is at least equal to that of the channel bottom, within said metal section there being provided rigid U-shaped stiffening members in a spaced apart relationship fixed to said upper stringers and channel bottom.

The solution according to the present invention, of employing as a self-supporting reinforcement for floor joists a metal U-shaped channel element has always been rejected in the prior art due to the supposed transverse instability under a combined bending and compressive stress, which such channel elements would be likely to show when subjected to a concentrated or equally distributed load, such as received through those blocks resting on the projecting edges of the U-shaped channel element itself. This technical prejudice is overcome according to the present invention by providing that the upper stringers of the metal channel element will have a cross-section at least equal to that of the lower leg or channel bottom, and preferably they will be made of the same sheet iron as the channel element, but bent on itself a number of times. It results therefrom an increased moment of inertia and a consequent displacement of the neutral axis towards the median line of the metal section until coinciding therewith.

It is to be appreciated that said bending of the sheet iron forming the channel-shaped section can be simply effected by means of a usual roll forming machine or a bending machine, of low cost and high production per hour.

The employment of rigid U-shaped stiffening members in spaced apart relationship has a consequence that nodes are created in the deflection line of each of the two upper stringers under load, whereby such deflection line will comprise harmonics of high order, which have a very higher cutical load, such as to become negligible with respect to the usual bending stresses.

BRIEF DESCRIPTION OF THE DRAWINGS

Further objects, advantages and features of the present invention will be apparent to those skilled in the art from the following detailed description of an embodiment thereof, given by way of a non-limiting example, with reference to the annexed drawings, in which.

DETAILED DESCRIPTION OF THE PREFERRED EMBODIMENT

Figure 1:
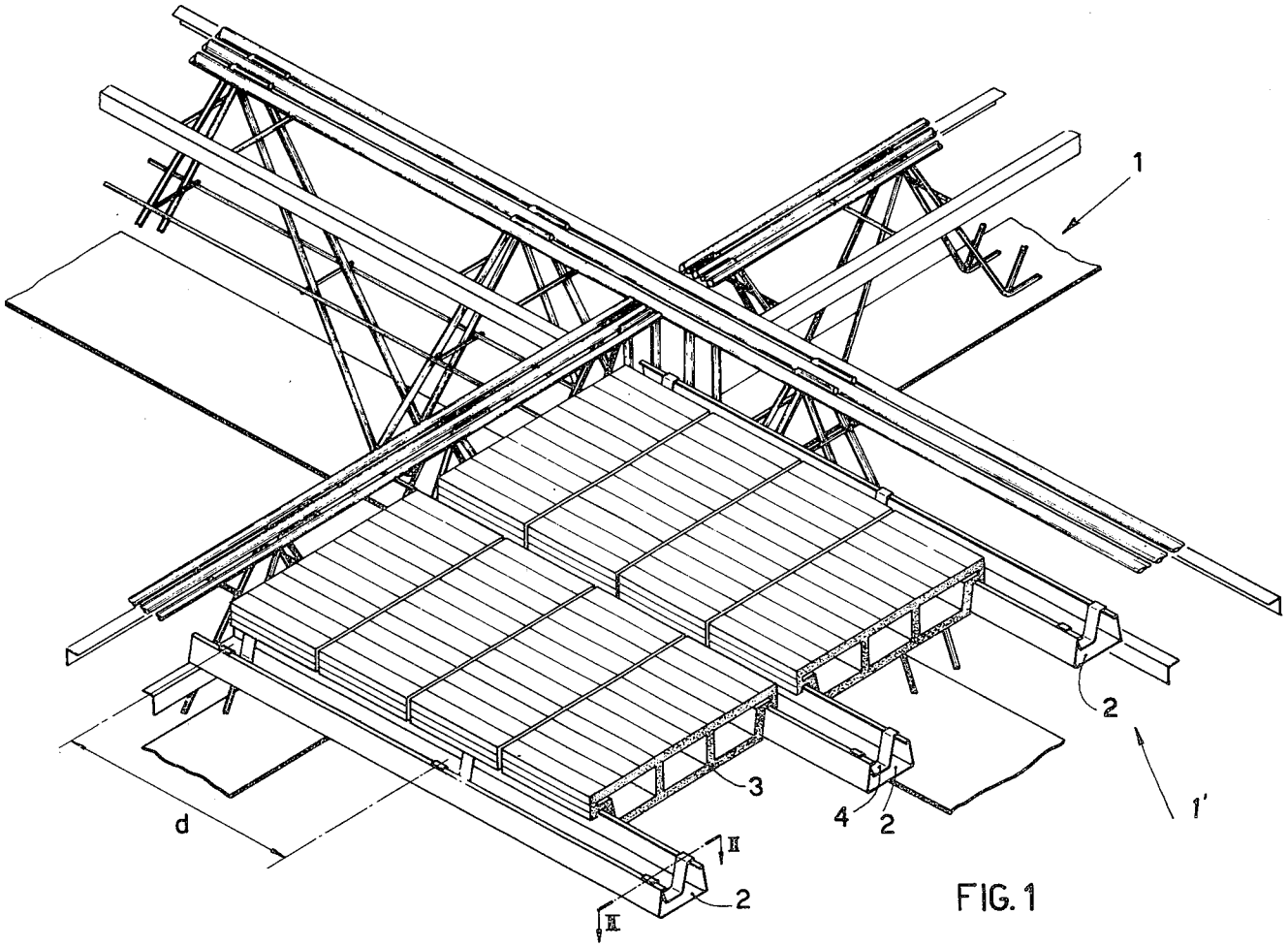
FIG. 1 is a partial perspective view of a composite-type concrete and block floor before the concrete casting, wherein channel-shaped elements according to the invention are used as the reinforcement of the joists on which the same blocks rest.

With reference to FIG. 1, a floor structure comprises main girders or beams 1, 1' in a perpendicular relationship, here illustrated of the self-supporting trestle type, to be embedded in a concrete casting, as disclosed and claimed in the U.S. Pat. No. 3,282,505 of the same Applicant. Upon such girders or beams, which could obviously be of a different type, there are made to rest metal U-channel shaped elements 2 parallel each other and equally spaced apart, so that blocks 3 which are the floor covering material are supported on their upper edges. By means of a concrete casting into each channel element 2 an intimate connection thereof with blocks 3 is obtained; which ensures the structural continuity of the floor.

Figure 2:
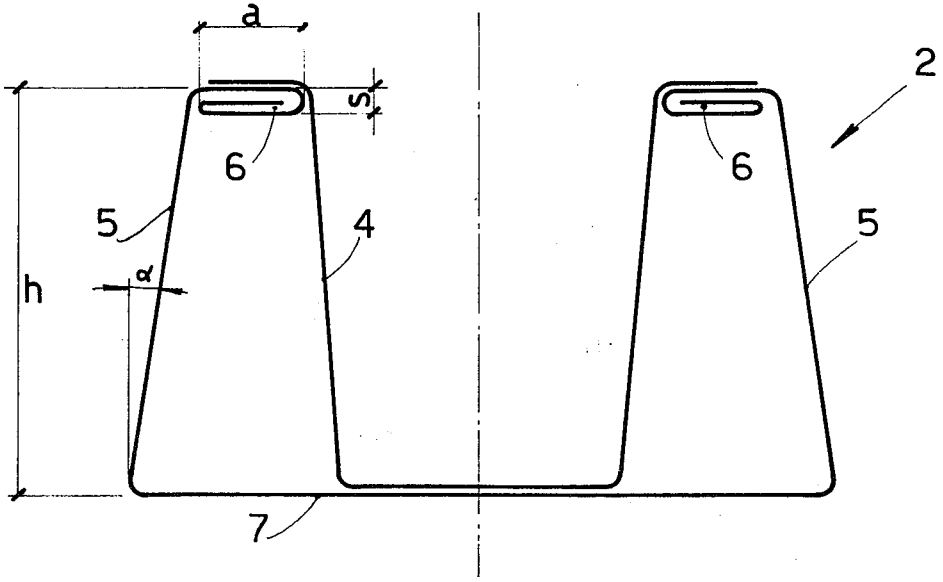
FIG. 2 is a cross-section view of a channel-shaped element of the invention along line II—II of FIG. 1.

Referring now to FIG. 2, the channel element of the present invention is shown in cross-section along the line II—II of FIG. 1, that is through a rigid U-shaped stiffening member 4. As it appears from the drawings, the channel element 2 comprises a substantially U-shaped metal section, having its side legs 5 slightly inclined inwardly, preferably of an angle $\alpha$ in a range from 3° to 7°. The upper ends of both the legs 5 are also bent inwardly, in a direction parallel to the lower side of the channel, or bottom of the U, having allotted reference numeral 7.

Figure 3:
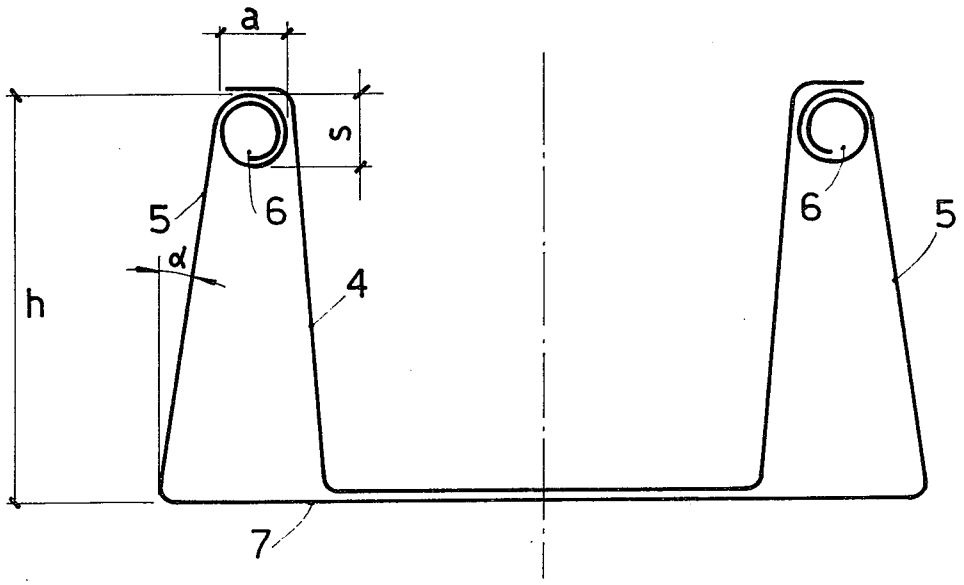
FIG. 3 is a cross-section view, similar to that of FIG. 2, of a second embodiment of the channel-shaped element according to the present invention.

The thus bent portions 6 are the upper stringers of the reinforcement for floor joists according to the present invention, and the bottom 7 is the corresponding lower stringer. When the structure so far described is used as in the arrangement of FIG. 1, the upper stringers 6, on which the blocks 3 are caused to rest, are subjected to a combined bending and compressive stress. In order to avoid that as a consequence of this there results a transverse instability of the structure, it has been found that, according to the present invention the upper stringers 6 will have a cross-section not less, but preferably greater than the lower stringer 7. This is achieved by bending on itself a number of times the section sheet at the ends of the two legs 5, by means of a usual bending machine or a roll forming machine, the latter of which causes each upper stringer to be loop-shaped as represented in FIG. 3 as second embodiment of the channel element according to the invention.

As already stated, at the inner side of the channel element 2, rigid U-shaped members 4 are fixed to the upper stringers and to the bottom 7, equally spaced apart by a distance *d*. Each rigid U-shaped member 4 corresponds to a node in the deflection curve of each of the two loaded upper stringers, which otherwise would have only two nodes at the end of the section 2, while resting as already stated on the beams 1, 1' or another support means. The harmonics of the deflection line, from the first order become therefore of a higher order *n*, related to the number of U-shaped members, fixed such as by welding, within the metal channel section. Thus the probabilities of a transverse instability under a combined bending and compressive stress are greatly reduced or even brought to zero.

To this purpose, it has been found that the optimized number, from a static point of view of the U-shaped members to be introduced into the channel section, depends on the thickness *s* and the width *a* of the upper stringer 6, and on the height *h* of the metal section. More precisely, the following optimized value of the distance *d* between two adjacent U-shaped members 4 has been found, as a function of the two parameters *a*, *s* relating to the upper stringers and the parameter *h* relating to the metal section:

$$\frac{d[\mathrm{cm}] = 325450\, s\, [10^{-1}\mathrm{mm}]\, a^3\, [\mathrm{cm}]}{h^3\ \mathrm{cm}}$$

With the above in mind, it is apparent the advantage of having the possibility of producing, by means of a usual bending or roll forming machine, associated with a known welding apparatus for fixing regularly U-shaped members 4 a continuous channel element according to the invention, ready to be cut at the desired lengths and adapted to be installed as shown in the arrangement of FIG. 1 in order to be employed as a self-supporting reinforcement, with no need of boxing, for the subsequent concrete casing by which the floor joists are found. As previously stated, and as it is known, the installation and operating costs of such machines is low and the production per hour is high.

Possible additions and/or modifications could be brought by those skilled in the art to the above described and illustrated embodiments of the channel-shaped element of the invention, without exceeding the scope of the invention itself. For example the resisting cross-section of the upper stringer would be increased through methods different from the bending and rolling of the upper free ends of the metal channel section.

What I claim is:

1. A metallic construction channel element disposed on a longitudinal axis thereof and adapted to be structurally integrated into concrete floors and the like comprising:

an elongated, unbroken and hollow section of U-shaped cross section having a bottom side, a pair of upstanding side legs each integrally secured at its lower end to a respective lateral edge of said bottom side and stringer means integrally formed on an upper end of each of said side legs, said pair of stringer means having a composite bending strength at least equal to the bending strength of said bottom side and each of said stringer means being formed by at least one reverse bend formed on the upper end of a respective side leg to extend inwardly therefrom towards said axis, and a plurality of U-shaped stiffening members spaced apart longitudinally along said axis and disposed within said section, each of said stiffening members having a base portion secured to said bottom side, a pair of upstanding side portions each integrally secured at its lower end to a respective lateral edge of said base portion and a flange integrally formed on an upper end of each of said side portions and extending away from said axis to overlie a respective one of said stringer means and secured thereon.

2. The element according to claim 1 wherein said stringer means are parallel relative to the bottom side of said section.

3. The element according to claim 1 wherein said U-shaped stiffening members are equally spaced apart by a distance *d* which is a function of the thickness *s* and width *a* of each of said stringer means and of the height *h* of the metal section in accordance with the formula $$\frac{d[\mathrm{cm}] = 325450\, s\, [10^{-1}\mathrm{mm}]\, a^3\, [\mathrm{cm}]}{h^3\, [\mathrm{cm}]}$$

4. The element according to claim 1 wherein said longitudinal axis is coincident with a median line of the transverse cross section of said channel element.

5. The element according to claim 1 wherein each of said stringer means is generally flat when viewed in transverse cross section.

6. The element according to claim 1 wherein each of said stringer means is generally circular when viewed in transverse cross section.

7. The element according to claim 1 wherein each of the bottom side and said side legs of said section are flat and wherein said side legs are symmetrically bent inwardly towards said axis to define a transverse cross section through said element which is shaped as an isosceles trapezoid having said bottom side defining the base thereof.

8. The element according to claim 7 wherein each of said side legs is bent inwardly towards said axis to define an included acute angle relative to an upstanding imaginary plane perpendicular to said bottom side which is selected from the range of from 3° to 7°.

* * * * *